US010005296B2

(12) United States Patent
Jo et al.

(10) Patent No.: US 10,005,296 B2
(45) Date of Patent: Jun. 26, 2018

(54) PRINTING APPARATUS INCLUDING THEREIN SHEET HOLDER

(71) Applicant: Brother Kogyo Kabushiki Kaisha, Nagoya-shi, Aichi-ken (JP)

(72) Inventors: Hidenori Jo, Nagoya (JP); Keiji Seo, Nagoya (JP); Takehiko Inaba, Chita-gun (JP); Yuki Nagashima, Toyokawa (JP); Hitoshi Sanada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days. days.

(21) Appl. No.: 15/457,151

(22) Filed: Mar. 13, 2017

(65) Prior Publication Data

US 2017/0341431 A1 Nov. 30, 2017

(30) Foreign Application Priority Data

May 30, 2016 (JP) ..... 2016-107202

(51) Int. Cl.
*B41J 11/58* (2006.01)
*B41J 15/04* (2006.01)
*B41J 11/00* (2006.01)

(52) U.S. Cl.
CPC ..... *B41J 11/58* (2013.01); *B41J 11/0045* (2013.01); *B41J 15/042* (2013.01)

(58) Field of Classification Search
CPC ..... B41J 3/4075; B41J 11/0025
See application file for complete search history.

(56) References Cited

U.S. PATENT DOCUMENTS

| | | | | |
|---|---|---|---|---|
| 5,860,753 | A * | 1/1999 | Beck | B41J 15/042 242/563.1 |
| 9,266,366 | B2 | 2/2016 | Nagashima et al. | |
| 9,290,026 | B2 | 3/2016 | Nagashima et al. | |
| 2007/0114713 | A1* | 5/2007 | Yonemoto | B65H 1/266 271/171 |
| 2010/0061790 | A1* | 3/2010 | Yu | B41J 3/4075 400/613 |
| 2011/0309570 | A1* | 12/2011 | Uchino | B65H 3/44 271/253 |
| 2014/0375738 | A1 | 12/2014 | Nagashima et al. | |
| 2015/0246568 | A1* | 9/2015 | Nagashima | B41J 15/042 347/104 |

FOREIGN PATENT DOCUMENTS

| | | | |
|---|---|---|---|
| JP | S62-56224 | A | 3/1987 |
| JP | 2009-184783 | A | 8/2009 |
| JP | 2015-006734 | A | 1/2015 |
| JP | 2015-160424 | A | 9/2015 |

* cited by examiner

*Primary Examiner* — Shelby Fidler
(74) *Attorney, Agent, or Firm* — Banner & Witcoff, Ltd.

(57) ABSTRACT

A printing apparatus includes a first supporting portion, a second supporting portion, and an adjusting mechanism. The adjusting mechanism includes a first rack, a second rack, a pinion gear, and a third supporting portion configured to movably support the first and second racks and configured to rotatably support the pinion gear. The third supporting portion includes first to fourth ribs. The first and second racks are respectively movable in first and second areas in an axial direction. The first area and the second area define one end and another end. The first rib and the fourth rib are positioned close to the another end, and the second rib and the third rib are positioned close to the one end.

8 Claims, 8 Drawing Sheets

PRINTING APPARATUS INCLUDING THEREIN SHEET HOLDER

CROSS REFERENCE TO RELATED APPLICATION

This application claims priority from Japanese Patent Application No. 2016-107202 filed May 30, 2016. The entire content of the priority application is incorporated herein by reference.

TECHNICAL FIELD

The present invention relates to a printing apparatus which can hold a roll of printing medium.

BACKGROUND

Printing apparatuses are known in the art, which can hold a roll of printing medium such as a label sheet. In the prior art, a printing apparatus includes a housing and a sheet holder provided in the housing to hold a roll of printing medium. The sheet holder has two first support units, two rack gears, two pinion gears, and a control unit. The first support units are arranged at the sides of the roll in the axial direction of the roll, respectively, and can be moved in the axial direction. The rack gears are provided on the two first support units, respectively, and the pinion gears mesh with the two rack gears, respectively. The rack gears and the pinions cooperate to move the two first support units. The control unit sets a protrusion between any two comb teeth provided in the housing, thereby controlling the motion of the two first support units in the axial direction. The sheet holder has two first holding parts at the ends spaced in the width direction of the rolled printing medium, and holds the roll in a rotatable state, while the control unit is controlling the motion of the two first support units.

SUMMARY

The printing apparatus may receive an impact while the sheet holder is holding a roll. This can happen if the printing apparatus is dropped onto the floor. If the printing apparatus receives an impact, the rack gears can be broken due to the weight of the roll.

An object of this disclosure is to provide a printing apparatus in which the rack gears are prevented from being broken due to the weight of the roll.

It is therefore an object of the disclosure to provide a printing apparatus including a first supporting portion, a second supporting portion, and an adjusting mechanism. The adjusting mechanism includes a first rack, a second rack, a pinion gear, and a third supporting portion configured to movably support the first rack and configured to rotatably support the pinion gear. The third supporting portion includes first to fourth ribs and first to second engaging grooves. The first supporting portion is configured to support a roll having a printing medium wound around an axis extending from a first side toward a second side in an axial direction. The first supporting portion supports the roll from the first side. The second supporting portion is configured to support the roll from the second side. The second supporting portion and the first supporting portion have an adjustable gap therebetween. The adjusting mechanism is configured to adjust the adjustable gap. The first rack includes a first guide portion having a first engaging part and connected to the first supporting portion, and a first rack gear portion extending from the first guide portion toward the second side in the axial direction. The first rack gear portion has a first gear and the first rack is movable in a first area in the axial direction. The second rack includes a second guide portion having a second engaging part and connected to the second supporting portion, and a second rack gear portion extending from the second guide portion toward the first side in the axial direction. The second rack gear portion is configured to face the first rack gear portion in a perpendicular direction perpendicular to the axial direction and has a second gear configured to face the first gear in the perpendicular direction. The second rack is movable in a second area in the axial direction. The first area and the second area define one end and another end in the perpendicular direction. The one end is closer to the second gear than the another end is to the second gear in the perpendicular direction. The pinion gear engages with the first gear and the second gear. The third supporting portion is configured to rotatably support the pinion gear and is configured to movably support the first rack and the second rack. The first engaging groove extends in the axial direction, and is configured to engage with the first engaging part to movably support the first guide portion in the axial direction. The second engaging groove extends in the axial direction and is configured to engage with the second engaging part to movably support the second guide portion in the axial direction. The first rib is positioned closer to the another end than to the one end of the first area in the perpendicular direction. The first rib and the first area provide therebetween a first gap in the perpendicular direction. The second rib is positioned closer to the one end than to the another end of the first area in the perpendicular direction. The second rib and the first area provide therebetween a second gap in the perpendicular direction. The third rib is positioned closer to the one end than to the another end of the second area in the perpendicular direction. The third rib and the second area provide therebetween the second gap in the perpendicular direction. The fourth rib is positioned closer to the another end than to the one end of the second area in the perpendicular direction. The fourth rib and the second area provide therebetween the first gap in the perpendicular direction.

BRIEF DESCRIPTION OF THE DRAWINGS

The particular features and advantages of the disclosure will become apparent from the following description taken in connection with the accompanying drawings, in which.

DETAILED DESCRIPTION

An embodiment of this disclosure will be described with reference to the accompanying drawing. A printing apparatus 1 according to the embodiment can be connected by an USB (registered tradename) cable to an external terminal (not shown). On the basis of the printing data received from the external terminal, the printing apparatus 1 can print characters and figures on a printing medium. The printing medium is heat-sensitive labels. The external terminal is a general-purpose personal computer (PC). The lower-right, upper-left, upper-right, lower-left, upper and lower parts of FIG. 1 will hereinafter be referred to as the right side, left side, back, front, upper surface and lower surface of the printing apparatus 1, respectively.

<Outline of the Printing Apparatus 1>

Figure 1:
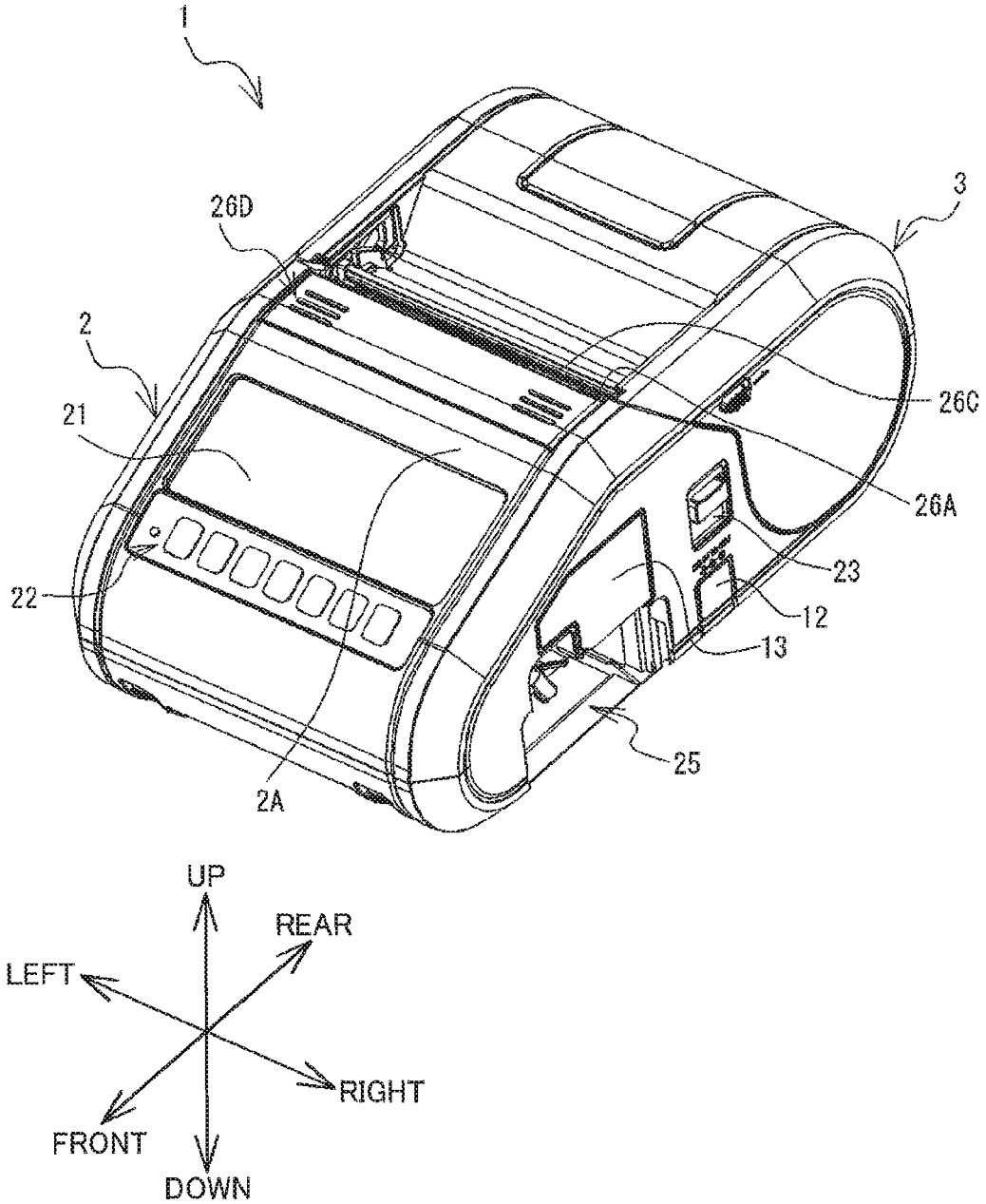
FIG. 1 is a perspective view of a printing apparatus in a state where a cover is closed, according to an embodiment.
Figure 2:
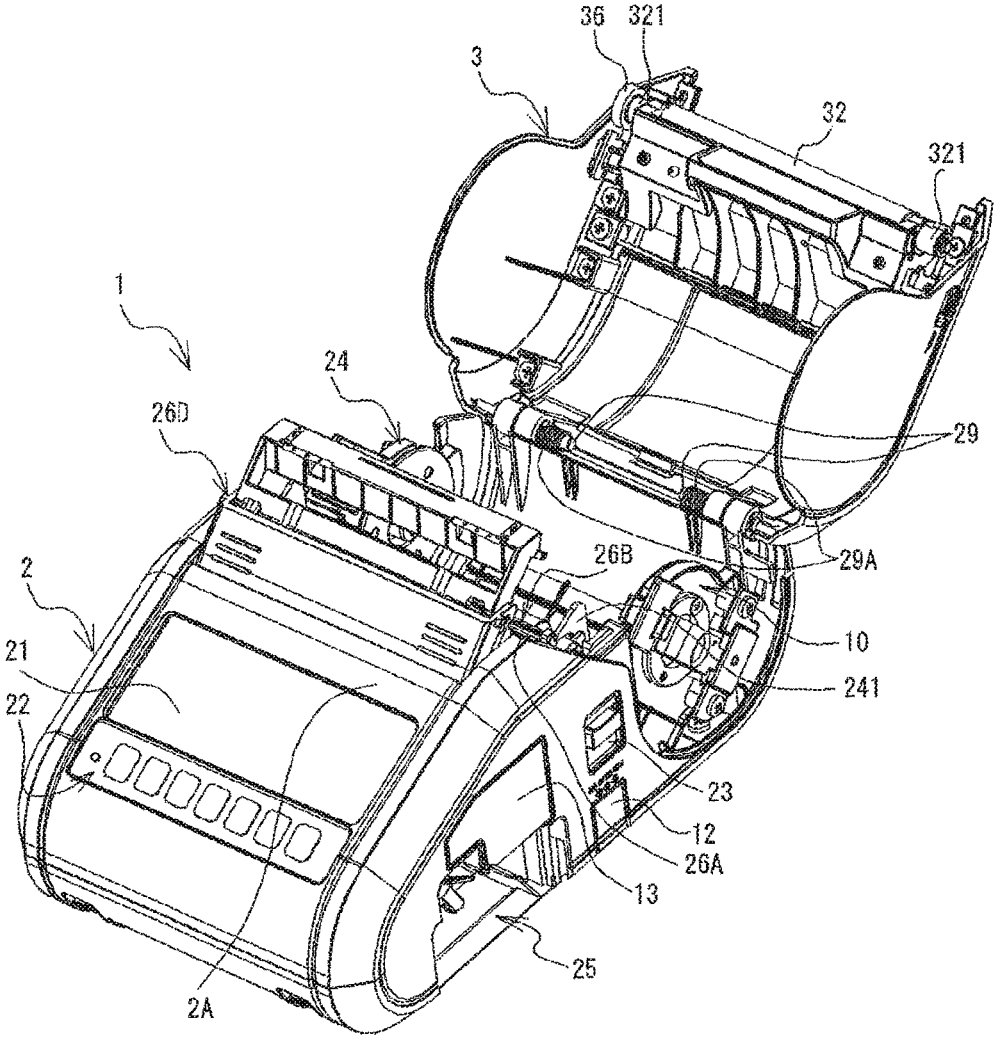
FIG. 2 is a perspective view of the printing apparatus in a state where the cover is opened, according to the embodiment.

The printing apparatus 1 will be outlined with reference to FIGS. 1 and 2. The printing apparatus 1 has a housing 2. The housing 2 incorporates a control section (not shown), a printing unit 26B (see FIG. 2), and a drive unit (not shown). The control section has a CPU for entirely controlling the printing apparatus 1. The printing unit 26B is a line-thermal head that can print data on heat-sensitive labels. The drive unit is a motor for transporting heat-sensitive labels. The housing 2 has a display unit 21 and switches 22 on the inclining front upper surface 2A. On the inclining front upper surface 2A of the housing 2, a sheet-peeling mechanism 26D is provided at the rear part of the display unit 21. The housing 2 has a roll-holding section 24 at the rear part of the sheet-peeling mechanism 26D (see FIG. 2). The housing 2 has, on the right side, a power-supplying unit 12, a USB (trademark) interface (I/F) 13, a lever 23, and a receptacle 25.

As shown in FIG. 2, the roll-holding section 24 provides a space for holding a roll 4 (see FIG. 3) which is composed of a hollow cylindrical core and a base sheet wound around the core. To the base sheet, heat-sensitive labels are bonded. Hereinafter, the base sheet and the heat-sensitive labels will be referred to as "tape." The roll-holding section 24 opens at the left and right ends and the upper part. In the roll-holding section 24, a sheet holder 10 is secured. The sheet holder 10 is a member for holding the roll 4. A cutting unit 26A is provided at the upper part of the front wall of the roll-holding section 24. The printing unit 26B is provided below the cutting unit 26A. The cutting unit 26A is blade that can cut a printed part from the tape. The cutting unit 26A and the printing unit 26B extend in the left-right direction. A pair of engaging parts 241 extends backward, respectively from the left and right ends of the front wall of the roll-holding section 24. Each engaging part 241 can be rotated around its lower end, and its upper end portion moves backward, if the lever 23 is pulled down. The base sheet is an example of a printing medium.

The printing apparatus 1 has a cover 3 supported by an axle 29 provided on the rear end portion of the roll-holding section 24. The cover 3 can be rotated to a position where it covers the roll-holding section 24 at the upper, left and right sides. Bias units 29A are wound around the axle 29. The bias units 29A are springs, and bias the cover 3 to rotate the cover 3 from the position where the cover 3 covers the roll-holding section 24 to the position where the cover 3 does not cover the roll-holding section 24. Hereinafter, the roll-holding section 24 will be referred to provide "closed state" while it remains covered with the cover 3 (as shown in FIG. 1) and to provide "opened state" while it remains not covered with the cover 3 (as FIG. 2).

The cover 3 supports a first roller 32 at its end portion disposed opposite to the portion supported by the axle 29, enabling the first roller 32 to rotate. The shaft of the first roller 32 extends in the left-right direction. Two engagement parts 321 extend outward from the left and right ends of the first roller 32, respectively. Each engagement part 321 has a pillar shape. A gear 36 is mounted on the left-end part of the left engagement part 321. Each engagement part 321 engages with the associated engaging part 241 while the cover 3 is closed. In this case, the engaging part 241 inhibits the cover 3 from rotating from the closed state to the opened state, and the cover 3 keeps its closed state.

While the cover 3 is closed, the printing unit 26B and the first roller 32 approach each other. While the cover 3 is closed as shown in FIG. 1, an ejection port 26C for ejecting the tape is provided between the sheet-peeling mechanism 26D and the first roller 32. While the cover 3 is closed, the gear 36 meshes with a main gear (not shown) provided in the housing 2. The main gear is coupled to the drive unit provided in the housing 2 and can be rotated by the drive unit. If the main gear is rotated while the cover 3 remains closed, the gear 36 and the first roller 32 will rotate. If the lever 23 is pulled down while the cover 3 remains closed, the engagement parts 321 will be disengaged from the engaging parts 241. The cover 3 is rotated by the bias of the bias units 29A, from the closed state to the opened state.

The power-supplying unit 12 has a socket to receive the plug of an AC adaptor. The USB (trademark) I/F 13 includes a plurality of terminals to which the connector of an USB cable can be connected. The printing apparatus 1 can perform data communication with an external terminal through the USB I/F 13. As illustrated in FIG. 1 and FIG. 2, the power-supplying unit 12 and the USB I/F 13 are covered with covers made of rubber. The receptacle 25 provides a space for accommodating a battery (not shown). The printing apparatus 1 can be driven by the power supplied from the power-supplying unit 12 or the power supplied from the battery held in the receptacle 25. In the printing apparatus 1, the battery held in the receptacle 25 can be recharged with the power supplied from the power-supplying unit 12.

Printing operation on a heat-sensitive label will be explained. First, a roll 4 is held in the sheet holder 10. Then, the cover 3 is closed. The tape having the label and fed from the roll 4 is inserted from below into the gap between the printing unit 26B and the first roller 32. The first roller 32 presses the tape onto the printing unit 26B with force of a prescribed value. Then, the drive unit rotates the first roller 32, and the tape is fed from the roll 4 and conveyed upward. At the same time, the selected heating elements of the printing unit 26B generate heat. Characters or figures, or both, are thereby printed on the heat-sensitive label. After the label has been printed, the tape with the label bonded to it is ejected outside from the ejection port 26C. The ejected tape is cut by the cutting unit 26A. In the printing apparatus 1, the tape may be ejected outside from the roll-holding section 24 while the sheet-peeling mechanism 26D is peeling the heat-sensitive label from the base sheet.

<Sheet Holder 10>

Figure 3:
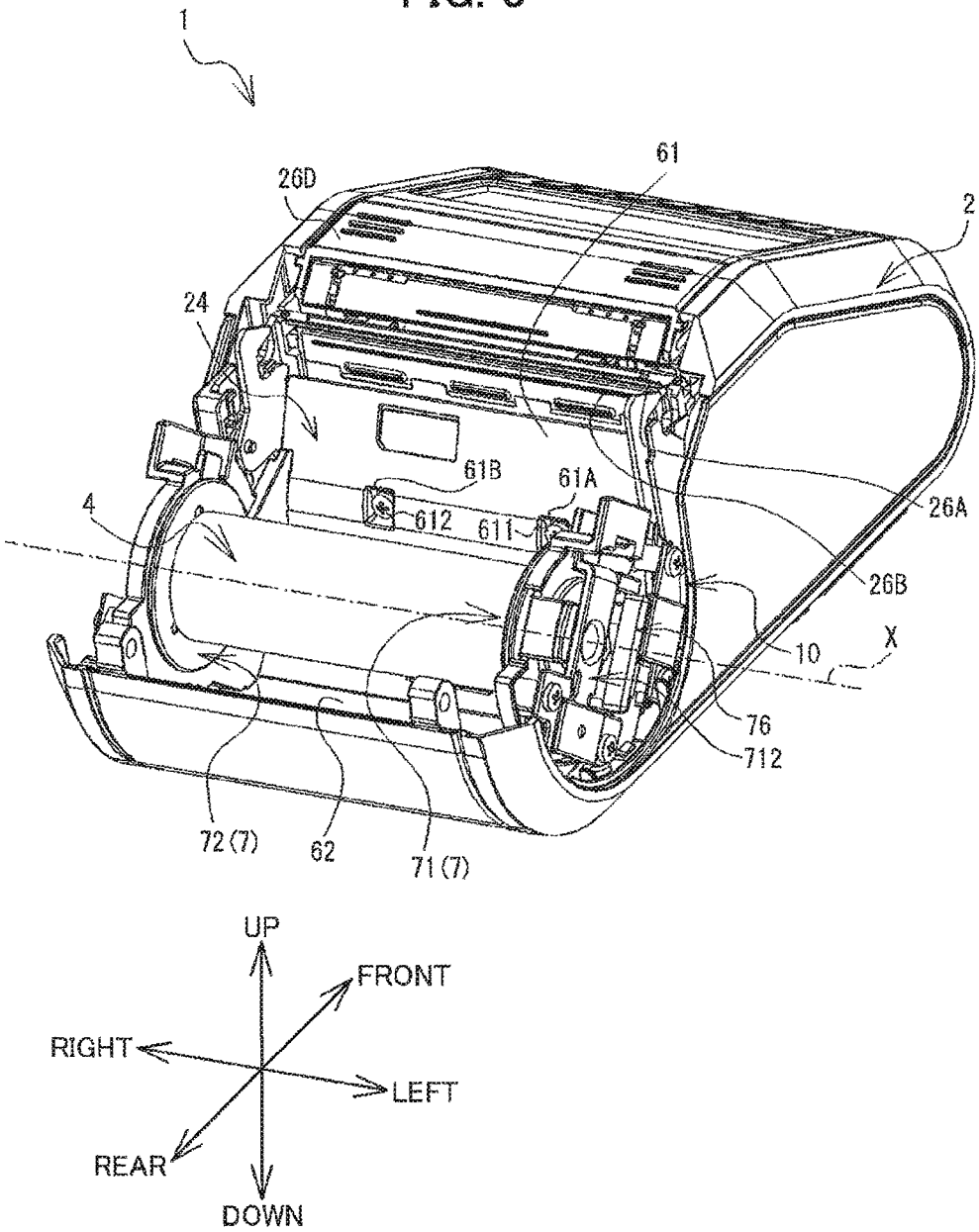
FIG. 3 is a perspective view of a roll 4 and a sheet holder 10 in a holding section 24 according to the embodiment.
Figure 4:
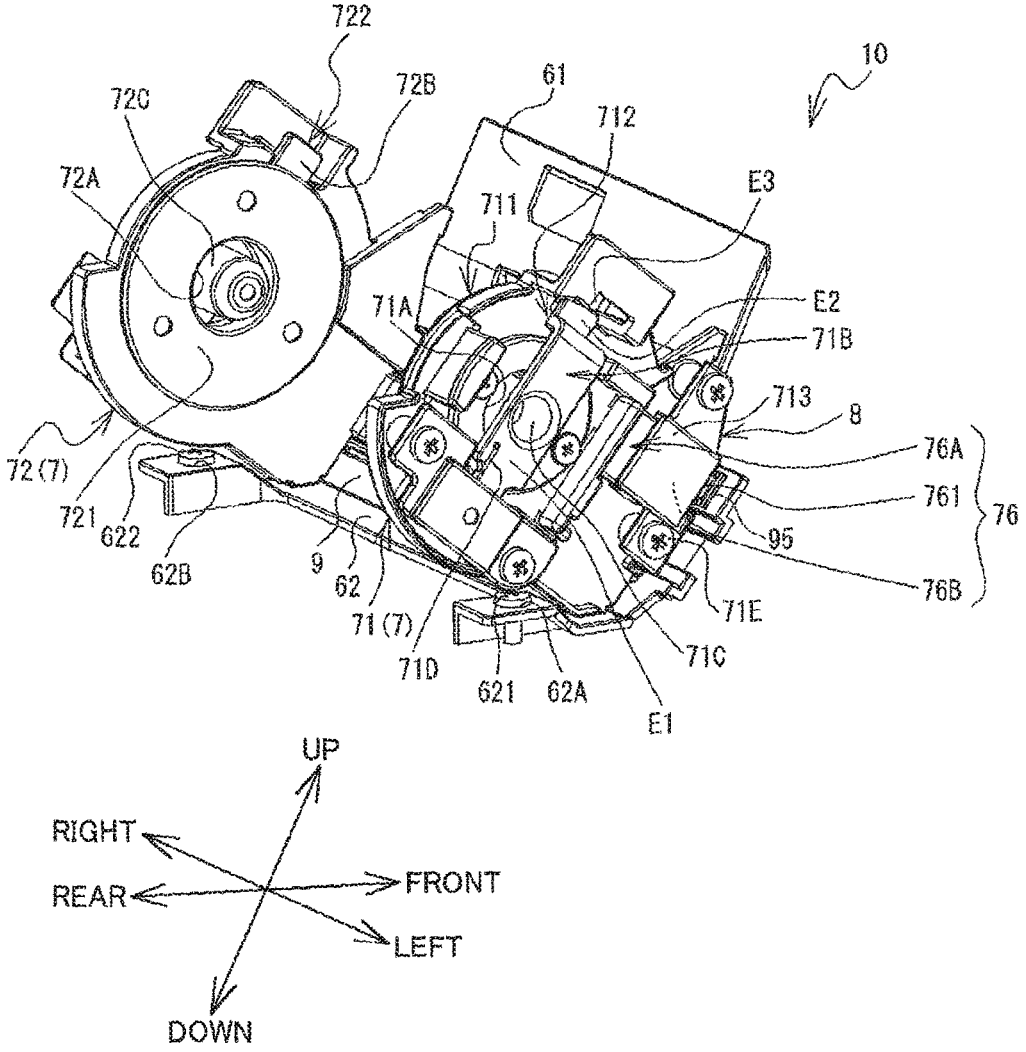
FIG. 4 is a perspective view of the sheet holder 10 viewed from a rear side according to the embodiment.

As shown in FIG. 3 to FIG. 6, the sheet holder 10 has holding parts 61 and 62, a supporting unit 7, a controlling part 76, and an adjusting mechanism 8. The holding part 61 is connected to the upper end portion of a third supporting portion 9 (described later) of the adjusting mechanism 8, and extends upward. The holding part 62 is connected to the lower end portion of the third supporting portion 9 and extends backward. The holding parts 61 and 62 secure the sheet holder 10 to the roll-holding section 24. More specifically, the holding part 61 has screw holes 61A and 61B as shown in FIG. 3, and screws 611 and 612 are inserted in the screw holes 61A and 61B, thereby securing the sheet holder 10 to the front wall of the roll-holding section 24. As shown in FIG. 4, the holding part 62 has screw holes 62A and 62B, and screws 621 and 622 are inserted in the screw holes 62A and 62B, thereby securing the sheet holder 10 to the lower wall of the roll-holding section 24. The directions applied to the printing apparatus 1 are also applied to the description of the holder 10 in a state where the holder 10 is secured to the roll-holding section 24 (i.e., forward, rearward, leftward, rightward, upward and downward).

<Supporting Unit 7>

As shown in FIG. 4, the supporting unit 7 has a first supporting portion 71 and a second supporting portion 72. The first supporting portion 71 and the second supporting portion 72 confront each other in the left-right direction. The first supporting portion 71 supports the left side of the roll 4 (see FIG. 3). The second supporting portion 72 supports the right side of the roll 4. The direction in which the roll 4 extends while supported by the supporting unit 7 will be referred to as "axial direction X" (see FIG. 3), which coincides with the left-right direction. The distance between the first supporting portion 71 and the second supporting portion 72 is adjusted in accordance with the length of the roll 4 (hereinafter called "width of the roll"). The first supporting portion 71 and the second supporting portion 72 are formed symmetric in the left-right direction. The first supporting portion 71 will be described in detail, while the second supporting portion 72 will be described briefly.

The first supporting portion 71 has a sidewall part 711 having a disc shape. The sidewall part 711 has flat surfaces facing the left-right direction. The sidewall part 711 has a circular opening 71A formed in the center part and having an axis extending in the left-right direction. The first supporting portion 71 has a rotatable part 712 on the left of the sidewall part 711. The rotatable part 712 has a main part 71B, a projecting part 71C and a biasing part 71D. The main part 71B is a rectangular plate. The main part 71B has protrusions E1, E2 and E3. The protrusion E1 extends forward and upward, in parallel to the sidewall part 711, from the rear-lower part of the sidewall part 711, and is then bent to the right and extends to the right. The protrusion E2 extends forward and upward, in parallel to the sidewall part 711, from right end portion of the protrusion E1, and is then bent to the right and extends to the right. The protrusion E3 extends forward and upward, from the right end portion of the protrusion E2.

A rear-lower end portion of the protrusion E1 is supported to the sidewall part 711 by a shaft (not shown) and can rotate around the shaft. The shaft extends from the rear-upper side to the front-lower side, extending parallel to the flat surface of the sidewall part 711. The biasing part 71D is provided on the rear-lower end portion of the protrusion E1. The biasing part 71D is a spring having one end connected to the sidewall part 711 and the other end connected to the protrusion E1. The biasing part 71D biases the main part 71B in the direction the front-upper end portion of the main part 71B extends from the left to the right, namely in the direction the protrusion E1 of the main part 71B approaches the sidewall part 711. The front-upper end portion of the main part 71B can therefore be moved by the bias of the biasing part 71D until the protrusion E2 contacts the left side of the sidewall part 711. Once the protrusion E2 has contacted the left side of the sidewall part 711, the protrusion E1 passes by the left-side part of the circular opening 71A, and the protrusion E3 projects outside the edge of the sidewall part 711.

The protrusion E1 has a projecting part 71C. The projecting part 71C projects from the right side of the protrusion E1 in the direction perpendicular to the plane of the protrusion E1. The projecting part 71C has a pillar shape and has a diameter smaller than that of the opening 71A. While the protrusion E1 extends parallel to the sidewall part 711, the projecting part 71C enters the first supporting portion 71 from the left and projects from the right side of the sidewall part 711 (see FIG. 5).

The second supporting portion 72 has a side-plate part 721 and a swing part 722. The side-plate part 721 has an opening 72A in the center part. The swing part 722 has a main part 72B, a projecting part 72C, and a biasing part (not shown). The side-plate part 721, swing part 722, opening 72A, main part 72B and projecting part 72C correspond to the sidewall part 711, rotatable part 712, opening 71A, main part 71B and projecting part 71C of the first supporting portion 71, respectively.

<Controlling Part 76>

Figure 7:
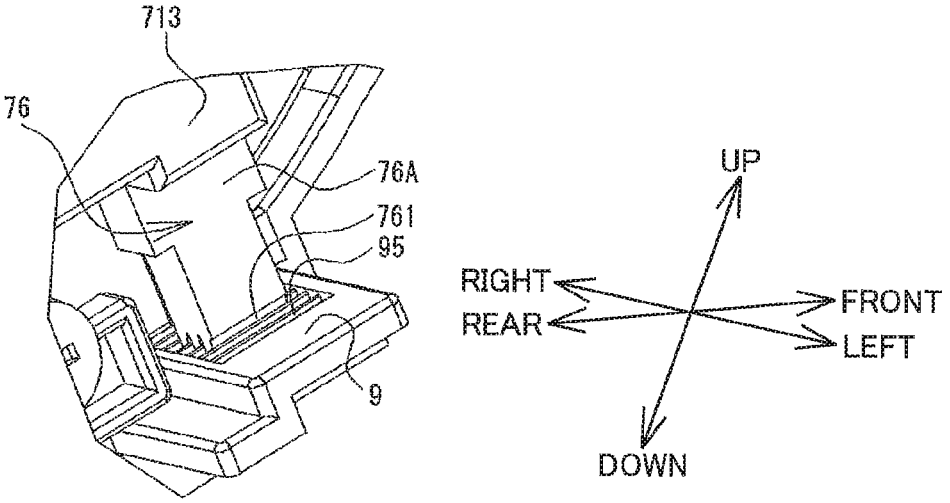
FIG. 7 is an enlarged perspective view of comb teeth and a projecting part according to the embodiment.
Figure 8:
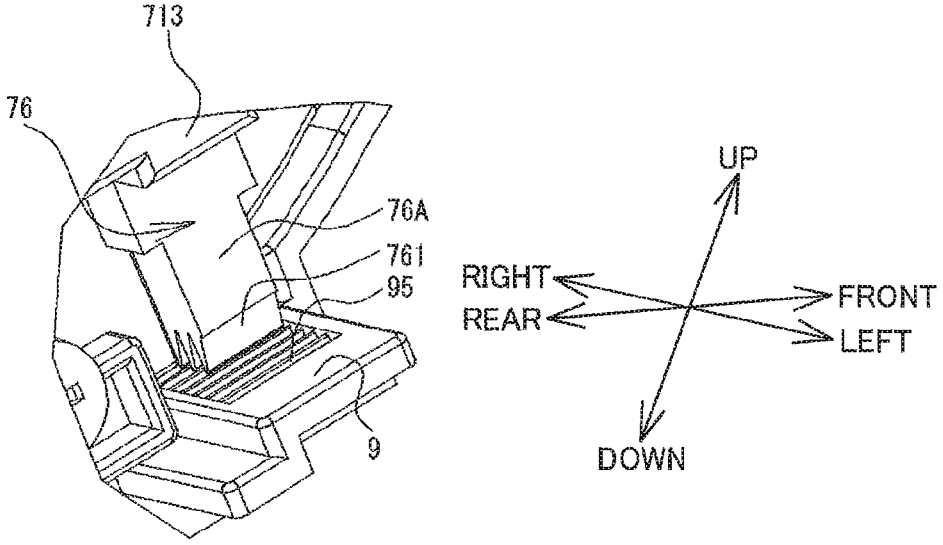
FIG. 8 is an enlarged perspective view of the comb teeth and the projecting part according to the embodiment.

As shown in FIG. 4, the controlling part 76 is provided on the left side of the first supporting portion 71. The controlling part 76 has a moving part 76A and a biasing part 76B. The moving part 76A extends from the rear-upper side to the front-lower side. The moving part 76A can move, while supported by a cover part 713 provided on the left side of the first supporting portion 71. The moving part 76A can move from a rear-upper position to a front-lower position, and vice versa. The moving part 76A has a projecting part 761 at its lower end. The projecting part 761 has a left-right width gradually decreasing toward the distal end. As shown in FIG. 7 and FIG. 8, the projecting part 761 projects downward from the cover part 713.

As shown in FIG. 4, the biasing part 76B is provided in the cover part 713. The biasing part 76B is a compression spring extending in the same direction as the moving part 76A extends. The biasing part 76B exerts biasing force on the moving part 76A acting from the rear-upper position to the front-lower position.

<Adjusting Mechanism 8>

Figure 6:
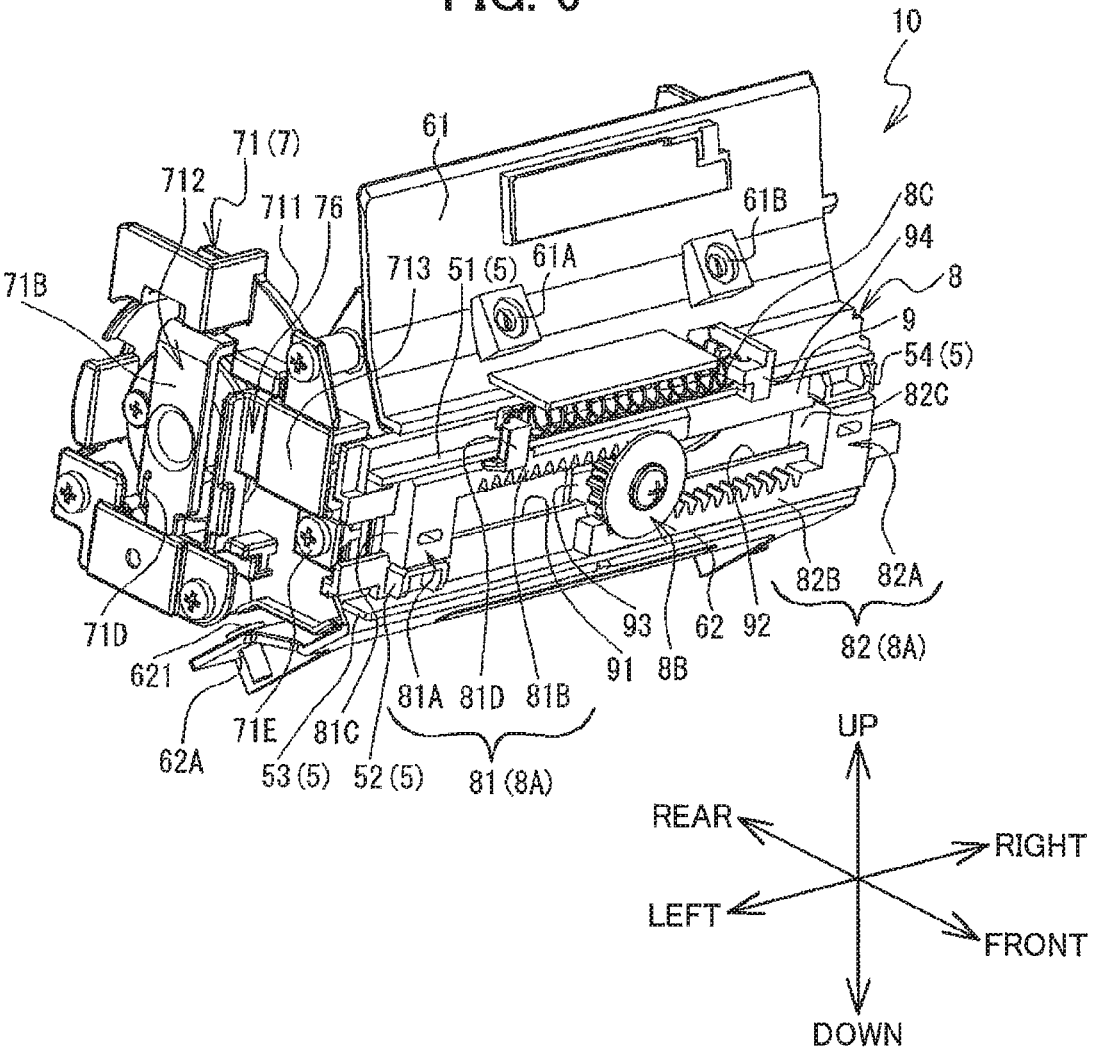
FIG. 6 is a perspective view of the sheet holder 10 viewed from a front side according to the embodiment.

As shown in FIG. 4 and FIG. 6, the adjusting mechanism 8 supports the first supporting portion 71 and second supporting portion 72 movably in the left-right direction. The adjusting mechanism 8 is arranged frontward of the roll 4 supported by the supporting unit 7 (see FIG. 3). As shown in FIG. 6, the adjusting mechanism 8 has a rack 8A, a pinion gear 8B, and a third supporting portion 9.

<Lack 8A>

The rack 8A has a first rack 81 and a second rack 82. The first rack 81 and the second rack 82 are substantially identical in shape. The first rack 81 has a first guide portion 81A, a first rack-gear portion 81B, and a spring holding part 81D. The first guide portion 81A has a rectangular shape having a long side extending in the up-down direction when viewed from the front side. A part of the first guide portion 81A, which lies below the center part, projects rearward. This part of the first guide portion 81A will hereinafter be referred to as "projecting part 81C." The rear end portion of the projecting part 81C is connected by screws 71E to the front part of the first supporting portion 71. The first rack-gear portion 81B linearly extends rightward from the right face of the upper part of the first guide portion 81A, which is above the middle part of the first guide portion 81A. The length of the first rack-gear portion 81B is about half the length of the sheet holder 10, as measured in the left-right direction. The first rack-gear portion 81B has teeth on the lower surface.

The spring holding part 81D extends upward from the upper surface of the first rack-gear portion 81B, more precisely from the center part of the upper surface of the first rack-gear portion 81B.

The spring holding part 81D has an upper end portion that hooks a left end portion of a biasing part 8C. The biasing part 8C extends in the left-right direction. The biasing part 8C in the embodiment is a tension spring.

The second rack 82 has a second guide part 82A and a second rack-gear part 82B. The second guide part 82A has a rectangular shape having a long side extending in the up-down direction when viewed from the front side. An upper part of the second guide part 82A, which a little above the center part in the up-down direction, projects backward. Hereinafter, this part will be referred to as "projecting part 82C." The rear end portion of the projecting part 82C is connected by screws 72E (see FIG. 5) to the front part of the second supporting portion 72. The second rack-gear part 82B linearly extends leftward from the left face of the lower part of the second guide part 82A, which is below the middle part of the second guide part 82A. The second rack-gear part 82B opposes a lower part of the first rack-gear portion 81B. The length of the second rack-gear part 82B in the left-right direction is about half the length of the sheet holder 10, as measured in the left-right direction. The second rack-gear part 82B has teeth on the upper surface.

<Pinion Gear 8B>

A pinion gear 8B is a circular gear. The pinion gear 8B is rotatably supported by the third supporting portion 9 (later described), below the first rack-gear portion 81B and above the second rack-gear part 82B. The pinion gear 8B has an axis extending in the front-rear direction.

<Third Supporting Part 9>

The third supporting portion 9 extends between the lower end portion of the holding part 61 and the front end portion of the holding part 62. The third supporting portion 9 has a plate shape. The third supporting portion 9 supports the first rack 81 and second rack 82, enabling them to move in the left-right direction. Further, the third supporting portion 9 rotatably supports the pinion gear 8B. The third supporting portion 9 has a first engagement groove 91, a second engagement groove 92, a supporting part 93, a spring holding part 94, comb teeth 95 (see FIG. 5), and ribs 5.

Figure 5:
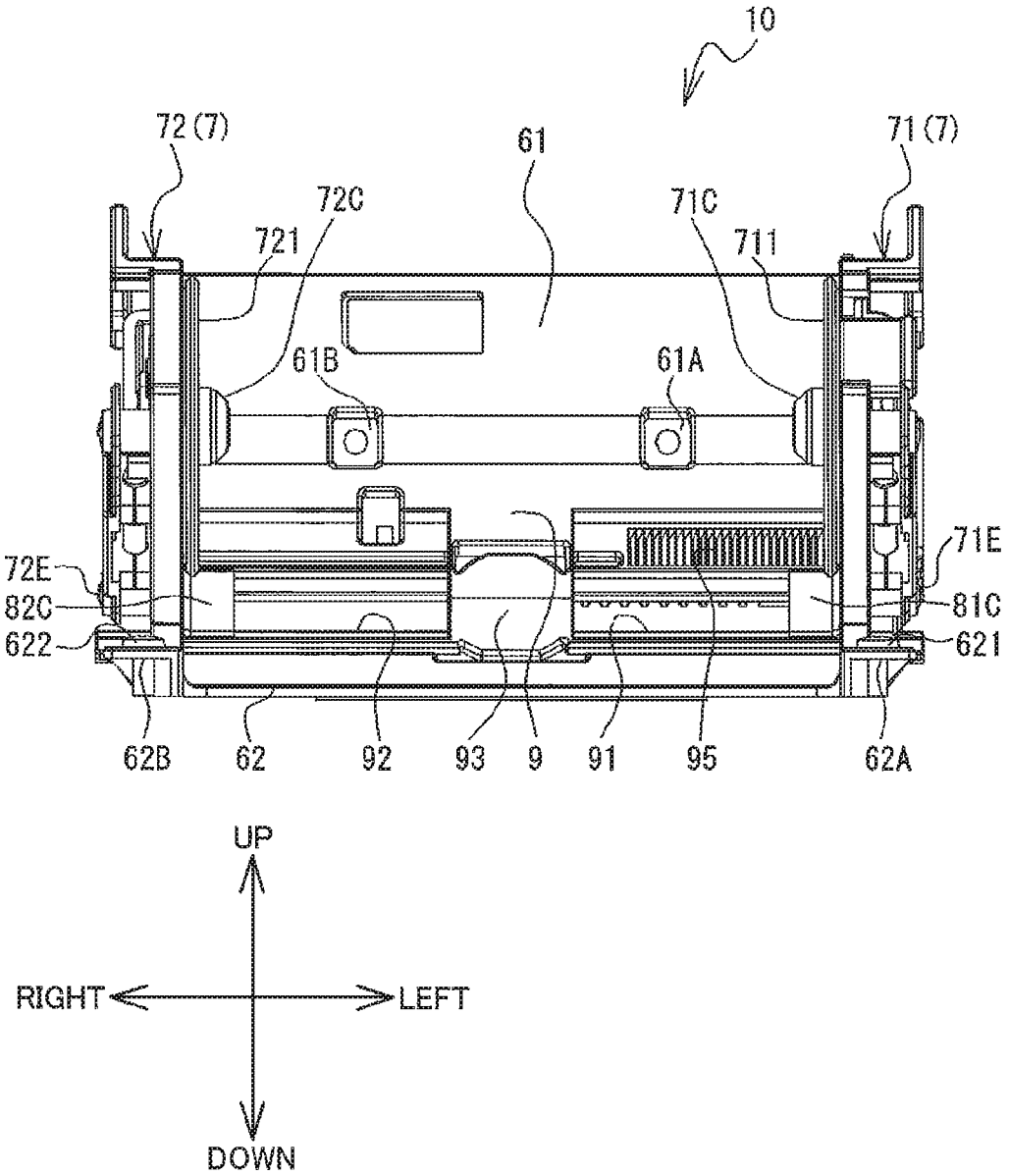
FIG. 5 is a rear view of the sheet holder 10 according to the embodiment.

As illustrated in FIG. 5 and FIG. 6, each of the first engagement groove 91 and the second engagement groove 92 has a rectangular shape linearly extending in the left-right direction. The first engagement groove 91 is arranged left side with respect to the second engagement groove 92. The supporting part 93 is positioned between the first engagement groove 91 and the second engagement groove 92, spacing them apart in the left-right direction.

The first engagement groove 91 extends rightward from the left end portion of the third supporting portion 9. The projecting part 81C of the first guide portion 81A engages in the first engagement groove 91. The first engagement groove 91 supports the first guide portion 81A, allowing the first guide portion 81A to move in the left-right direction. The first guide portion 81A can therefore move between the middle part of the third supporting portion 9 and the left end portion thereof, in the left-right direction. The first guide portion 81A (except the projecting part 81C) and the first rack-gear portion 81B are arranged frontward of the third supporting portion 9. The first rack-gear portion 81B is arranged above the first engagement groove 91. The first supporting portion 71 is arranged backward of the third supporting portion 9.

The second engagement groove 92 extends leftward from the right end portion of the third supporting portion 9. The projecting part 82C of the second guide part 82A engages in the second engagement groove 92. The second engagement groove 92 supports the second guide part 82A, allowing the second guide part 82A to move in the left-right direction. Accordingly, the second guide part 82A can move substantially between the horizontal center part and the right end portion of the third supporting portion 9 in the left-right direction. The second guide part 82A (except the projecting part 82C) and the second lack-gear part 82B are arranged frontward of the third supporting portion 9. The second rack-gear part 82B is arranged below the second engagement groove 92. The second supporting portion 72 is arranged backward of the third supporting portion 9.

The supporting part 93 has a front face rotatably supporting the pinion gear 8B. The pinion gear 8B meshes or engages with the first rack-gear portion 81B at its upper teeth, and with the second rack-gear part 82B at its lower teeth. The first rack-gear portion 81B, second rack-gear part 82B and pinion gear 8B are therefore moved in the left-right direction in conjunction with the first guide portion 81A and the second guide part 82A. As the first rack-gear portion 81B, second rack-gear part 82B and pinion gear 8B are so moved, the first supporting portion 71 connected via the projecting part 81C to the first guide portion 81A and the second supporting portion 72 connected by the projecting part 82C to the second guide part 82A are also moved in the left-right direction.

Figure 9:
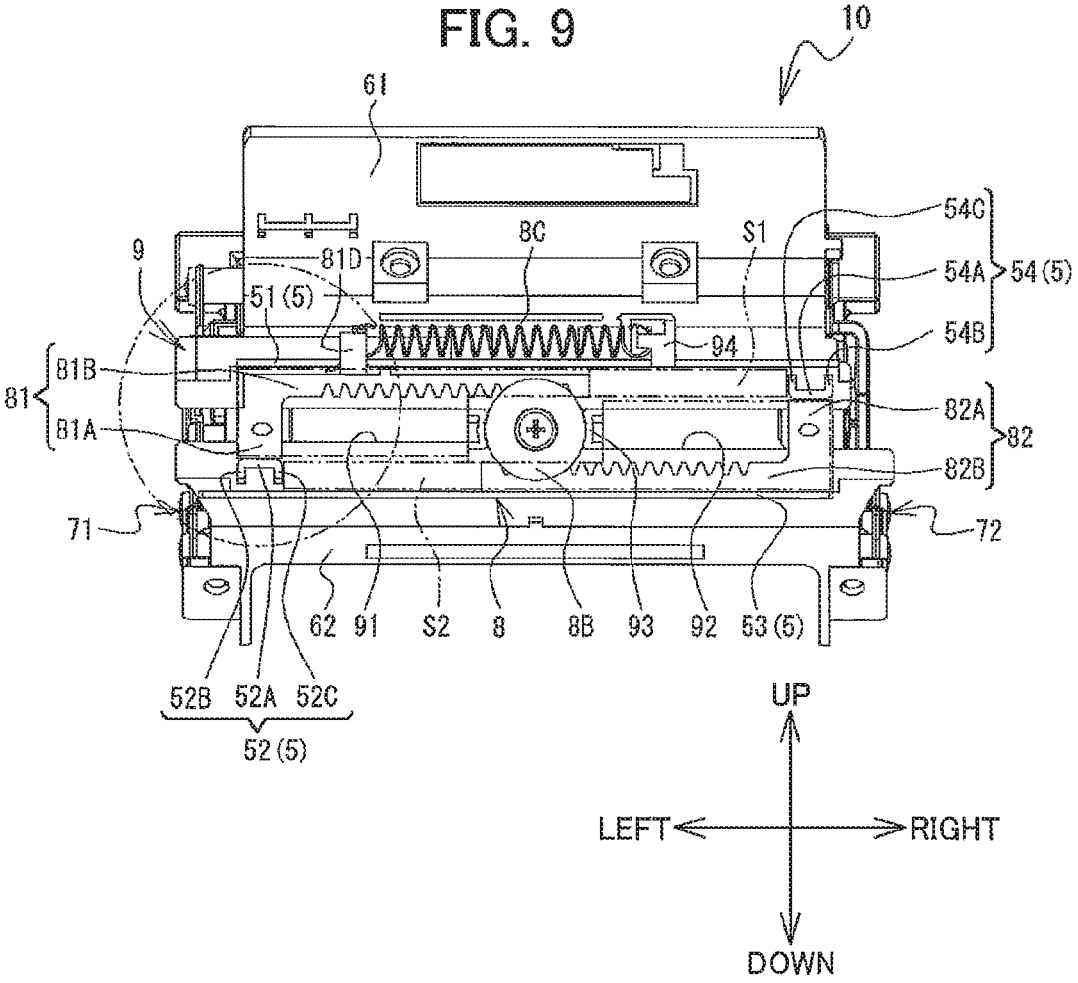
FIG. 9 is a front view of the sheet holder 10 according to the embodiment.

If the first supporting portion 71 moves to the left by a prescribed distance, the first rack-gear portion 81B, pinion gear 8B and second rack-gear part 82B move the second supporting portion 72 rightward. That is, the first rack-gear portion 81B, pinion gear 8B and the second rack-gear part 82B drive the first supporting portion 71 and second supporting portion 72 away from each other (in the left-right direction). The leftward motion of the first supporting portion 71 and the first rack 81 is restricted by contacting with a part of the cover 3, which covers the left side of the roll-holding section 24 (see FIG. 2). Similarly, the rightward motion of the second supporting portion 72 and second rack 82 is restricted by contacting with a part of the cover 3, which covers the right side of the roll-holding section 24 (see FIG. 2). FIG. 5, FIG. 6 and FIG. 9 illustrate the state where the first supporting portion 71 and second supporting portion 72 are prevented from moving leftward and rightward, respectively, by the cover 3.

If the first supporting portion 71 moves rightward by a prescribed distance, the first rack-gear portion 81B, pinion gear 8B and second rack-gear part 82B move the second supporting portion 72 leftward by a prescribed distance. That is, the first rack-gear portion 81B, pinion gear 8B and second rack-gear part 82B drive the first supporting portion 71 and second supporting portion 72 to approach each other (inward in the left-right direction). The rightward motion of the first supporting portion 71 and first rack 81 is restricted as the right end portion of the first guide portion 81A contacts the left end portion of the supporting part 93 (see FIG. 2). Similarly, the leftward motion of the second supporting portion 72 and second rack 82 is restricted as the left end portion of the second guide part 82A contacts the right end portion of the supporting part 93. Hereinafter, the region in which the first rack 81 moves in the left-right direction in conjunction with the first guide portion 81A and the second guide part 82A will be referred to as "first region S1." The region in which the second rack 82 moves in the left-right direction in conjunction with the first guide portion 81A and second guide part 82A will be referred to as "second region S2." In FIG. 9 and FIG. 10, the first region S1 and the second region S2 are represented by two-dot chain lines. The first region S1 and the second region S2 partly overlap the first rack 81 and the second rack 82, but in FIG. 10 they are illustrated as if spaced a little away from the first rack 81 and second rack 82 (indicated by solid lines), in order to illustrate their positions clearly.

The spring holding part 94 extends forward from the front face of the third supporting portion 9 and from the upper part of the second engagement groove 92. The biasing part 8C is engaged, at the right end, with the spring holding part 94. The biasing part 8C exerts biasing force on the first rack 81 rightward. That is, the biasing part 8C biases the first supporting portion 71 connected to the first guide portion 81A of the first rack 81, making the first supporting portion 71 and the second supporting portion 72 approach each other.

As shown in FIG. 5, the comb teeth 95 are provided at the rear portion of the third supporting portion 9 and above the first engagement groove 91. The comb teeth 95 are spaced apart at even intervals in the left-right direction. As shown in FIG. 7 and FIG. 8, the comb teeth 95 are arranged in a front-lower position with respect to the moving part 76A of the controlling part 76. If the moving part 76A is moved to the front-lower position by the biasing force of the biasing part 76B (see FIG. 4), the projecting part 761 engages with the comb teeth 95 as shown in FIG. 7. In this case, the moving part 76A is inhibited from moving in the left-right direction. Otherwise, if the moving part 76A moves to the rear-upper position against the bias of the biasing part 76B, the projecting part 761 disengages with the comb teeth 95 as shown in FIG. 8. In this case, the moving part 76A can move in the left-right direction.

<Rib 5>

As shown in FIG. 9, first rib 51, second rib 52, third rib 53 and fourth rib 54 (hereinafter, generally called "ribs 5") are provided on the front face of the third supporting portion 9. The ribs 5 have plate shapes and protrude forward from the front face of the third supporting portion 9 (see FIG. 6). The first rib 51 and the third rib 53 are identical in shape, and the second rib 52 and the fourth rib 54 are identical in shape.

Figure 10:
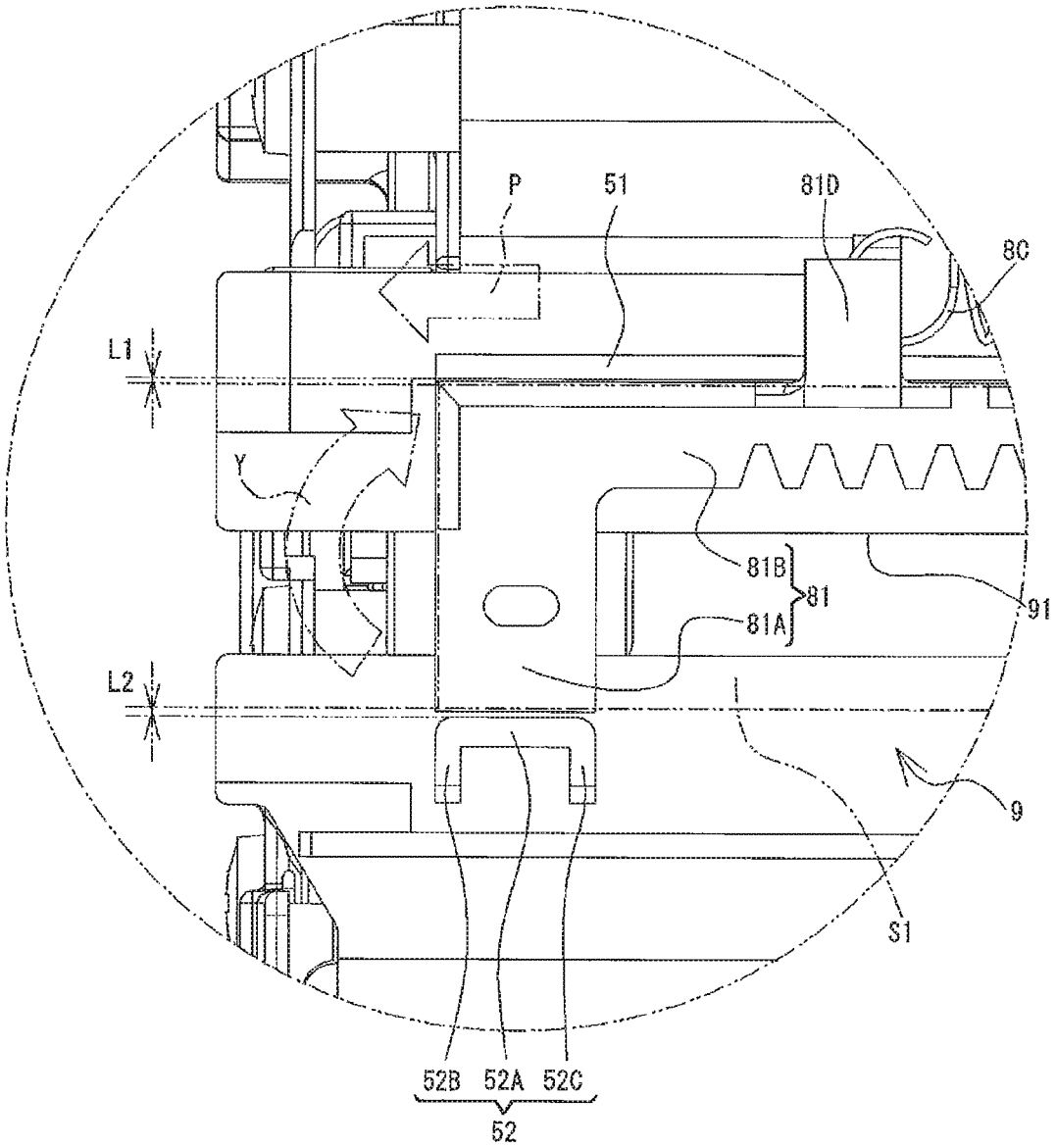
FIG. 10 is an enlarged front view of the sheet holder 10 according to the embodiment.

The first rib 51 is provided above the first and second engagement grooves 91 and 92 and supporting part 93 of the third supporting portion 9. The first rib 51 linearly extends in the left-right direction, over the entire upper side of the first region S1. More specifically, the left end portion of the first rib 51 is positioned at the left end portion of the first region S1. In other words, it is positioned substantially at the left end portion of the first guide portion 81A if the first rack 81 has moved to its leftmost position. The right end portion of the first rib 51 is positioned at the right end portion of the first region S1. In other words, the right end portion of the first rib 51 is positioned rightward of the right end portion of the first guide portion 81A if the first rack 81 has moved to its rightmost position. As shown in FIG. 10, the first rib 51 is spaced apart from the first region S1 by a prescribed distance (hereinafter referred to as "first gap L1"). The first gap L1 is, for example, 0.2 mm long.

As shown in FIG. 9, the third rib 53 is provided below the first engagement groove 91, second engagement groove 92 and supporting part 93 of the third supporting portion 9. The third rib 53 linearly extends over the entire lower part of the second region S2 in the left-right direction. More precisely, the right end portion of the third rib 53 substantially aligns with right end portion of the second region S2. In other words, it is positioned substantially at a right end portion of the second guide part 82A if the second rack 82 has moved to its rightmost position. The left end portion of the third rib 53 is arranged on the left end portion of the second region S2, or on the left of left end portion of second rack-gear part 82B if the second rack 82 is located at the leftmost position. Although not illustrated, the second rib 52 is spaced from the second region S2 by the first gap L1.

The second rib 52 is provided below the third supporting portion 9 and near the left end portion of the first engagement groove 91, and above the left end portion of the third rib 53. The second rib 52 has a first portion 52A and second portions 52B and 52C. The first portion 52A linearly extends below and near the left end portion of the first region S1, and along the lower end portion of the first region S1 in the left-right direction. More specifically, the first portion 52A extends below the first guide portion 81A in the left-right direction if the first rack 81 has moved to its leftmost position. The first guide portion 81A and the first portion 52A have substantially the same length in the left-right direction. As shown in FIG. 10, the first guide portion 81A and the first portion 52A are spaced apart by a prescribed distance, providing a gap (hereinafter called "second gap L2"). The second gap L2 is, for example, 0.5 mm long. The second gap L2 is longer than the first gap L1.

The second portion 52B extends downward from the left end portion of the first portion 52A. The other second portion 52C extends downward from the right end portion of the first portion 52A. The second portion 52C is provided at the left side of the second region S2, more precisely at the left side of the second rack-gear part 82B when the second rack 82 is moved to its leftmost position. The second portions 52B and 52C have equal dimensions in the up-down direction. The second portions 52B and 52C are shorter in the up-down direction than the first portion 52A in the left-right direction.

The fourth rib 54 is provided above the right end portion of the second engagement groove 92 of the third supporting portion 9, and below the right end portion of the first rib 51. The fourth rib 54 has a third portion 54A and fourth portions 54B and 54C. The third portion 54A linearly extends above and near the right end portion of the second region S2, and along the upper end portion of the second region S2 in the left-right direction. More specifically, the third portion 54A extends above the second guide part 82A in the left-right direction when the second rack 82 is moved to its rightmost position. The second guide part 82A and the third portion 54A have substantially the same length in the left-right direction. Although not illustrated, the third portion 54A is spaced apart from the second region S2, providing the second gap L2.

The fourth portion MB extends upward from the right end portion of the third portion 54A. The other fourth portion 54C extends upward from the left end portion of the third portion 54A. The fourth portion 54C is provided at the right side of the first region S1, more precisely at the right side of the first rack-gear portion 81B when the first rack 81 is moved to its rightmost position. The fourth portions 54B and 54C have equal dimensions in the up-down direction. The fourth portions 54B and 54C are shorter in the up-down direction than the third portion 54A in the left-right direction.

<Insertion and Removal of the Roll 4>

Insertion and removal of the roll 4 with respect to the printing apparatus 1 will be explained. As seen from FIG. 8, the user can move the moving part 76A of the controlling part 76 to the rear-upper position against the biasing force of the biasing part 76B (see FIG. 4) to thereby keep the moving part 76A at this position. Therefore, the projecting part 761 disengages with the comb teeth 95, and the first supporting portion 71 and the second supporting portion 72 can move in the left-right direction. Then, the user moves the first supporting portion 71 and the second supporting portion 72 away from each other as illustrated in FIG. 4, and sets the roll 4 between the first supporting portion 71 and the second supporting portion 72 (see FIG. 3). The user moves the first supporting portion 71 and second supporting portion 72 to each other in the left-right direction, reducing the space between the supporting parts 71 and 72 to the length of the roll 4. The supporting parts 71 and 72 are biased to each other in the left-right direction by the biasing part 8C. The supporting parts 71 and 72 therefore well contact the ends of the roll 4, leaving no gaps between them and the roll 4.

Thereafter, the user releases the moving part 76A of the controlling part 76. The moving part 76A therefore moves in the front-down direction as shown in FIG. 7 by the bias of the biasing part 76B, and the projecting part 761 engages with any of the comb teeth 95. The first supporting portion 71 and the second supporting portion 72 are thereby inhibited from moving in the left-right direction. As shown in FIG. 5, the projecting part 71C of the first supporting portion 71 and the projecting part 72C of the swing part 722 are inserted in the core of the roll 4, thereby supporting the roll 4 at both ends. The sidewall part 711 of the first supporting portion 71 and the side-plate part 721 of the second supporting portion 72 support the roll 4 at the left and right ends, respectively. Then, data can be printed on the heat-sensitive labels on the rolled sheet.

<Main Function and Advantages of the Embodiment>

The first rack-gear portion 81B and the second rack-gear part 82B mesh with the pinion gear 8B. The first supporting portion 71 and the second supporting portion 72 can therefore move in the left-right direction in the interlocking relation. If the printing apparatus 1 is dropped onto the ground by mistake, it receives an impact. In this case, the projecting part 761 of the controlling part 76 can disengage from the comb teeth 95. If this happens, the first supporting portion 71 and the second supporting portion 72 move in the left-right direction due to the weight of the roll 4. The weight of the roll 4 may act leftward (in the direction of arrow P) to exert a force on the first rack 81 via the first supporting portion 71 in the clockwise direction (i.e., direction of arrow Y) as viewed from the front (see FIG. 10).

If the first rack 81 were rotated by the force, the force would act on the first rack-gear portion 81B, possibly breaking the first rack-gear portion 81B. The second rack-gear part 82B could be similarly broken if the weight of the roll 4 acts rightward as the printing apparatus 1 receives an impact. The first rack-gear portion 81B and second rack-gear part 82B would be broken, because the teeth are thin (in the up-down direction) and are relatively mechanically weak.

On the contrary, in the printing apparatus 1, the ribs 5 (i.e., first rib 51 to fourth rib 54) are provided. The first rib 51 and the second rib 52 are arranged at the upper and lower side of the first region S1, respectively, and inhibit the first rack 81 from moving in the up-down direction. The third rib 53 and the fourth rib 54 are arranged at the upper side and the lower side of the second region S2, respectively, and inhibit the second rack 82 from moving in the up-down direction.

Hence, the first rib 51 to the fourth rib 54 inhibit the first rack 81 and the second rack 82 from rotating if an impact is applied to the printing apparatus 1. Therefore, the first rib 51 to the fourth rib 54 can prevent the first rack 81 and second rack 82 from being broken in spite of the weight of the roll 4, if an impact is applied to the printing apparatus 1.

In the printing apparatus 1, the first gap L1 is provided between the first region S1 and the first rib 51 and between the second region S2 and the third rib 53. The second gap L2 is provided between the first region S1 and the second rib 52 and between the second region S2 and the fourth rib 54. Hence, in manufacturing the printing apparatus 1, the first rack 81 and second rack 82 can be appropriately secured to the third supporting portion 9 even if the first rack 81 and second rack 82 have sized different from the design values.

In manufacturing the printing apparatus, the first rack 81 is moved down so that the teeth of the first rack-gear portion 81B engage with those of the pinion gear 8B, and the second rack 82 is moved up to so that the teeth of the second rack-gear part 82B engage with those of the pinion gear 8B. The second gap L2 is larger than the first gap L1. Therefore, in manufacturing the printing apparatus 1, the position of the lower end portion of the first rack 81 can be changed more than the position of the upper end, and the position of the upper end portion of the second rack 82 can be changed more than the position of the lower end. Hence, the first rack 81 and the second rack 82 can be easily assembled in the housing of the printing apparatus 1.

The second rib 52 has a first portion 52A and second portions 52B and 52C. The first portion 52A linearly extends below and adjacent to the left end portion of the first region S1, and along the lower end portion of the first region S1 in the left-right direction. The second portion 52B extends downward from the left end portion of the first portion 52A. The second portion 52C extends downward from the right end portion of the first portion 52A. The second portions 52B and 52C can therefore increase the mechanical strength of the second rib 52 against the force applied downward to the second rib 52. Further, the first portion 52A can be strengthened in the left-right direction since the second portions 52B and 52C are provided at the both ends of the first portion 52A. The second rib 52 can appropriately inhibit the first rack 81 from rotating if an impact is applied to the printing apparatus 1.

The fourth rib 54 has a third portion 54A and fourth portions 54B and 54C. The third portion 54A linearly extends above and adjacent to the right end portion of the second region S2, and along the upper end portion of the second region S2 in the left-right direction. The fourth portion 54B extends upward from the right end portion of the third portion 54A. The fourth portion 54C extends upward from the left end portion of the third portion 54A. The fourth parts 52B and 54C can increase the strength of the fourth rib 54 against the force applied upward to the fourth rib 54. Further, the strength of the third portion 54A can be increased in the left-right direction because the fourth parts 52B and 54C are provided at the ends of the third portion 54A. Hence, the fourth rib 54 can appropriately prevent the second rack 82 from rotating even if the printing apparatus 1 receives an impact.

The first rib 51 linearly extends above the entire first region S1 in the left-right direction. The third rib 53 linearly extends below the entire second region S2 in the left-right direction. Therefore, the printing apparatus 1 can inhibit the first rack 81 and second rack 82 from rotating in the whole area expanding in the left-right direction. Moreover, in the printing apparatus 1, the first rack 81 and second rack 82 can be prevented from rotating, regardless of the positions the first rack 81 and second rack 82 take in the axial direction.

If an impact is applied to the printing apparatus 1, the first rack 81 and second rack 82 move in the left-right direction as much as possible. Thereafter, the weight of the roll 4 is applied to the first rack 81 and second rack 82 in the rotating direction (see FIG. 10). The first portion 52A of the second rib 52 extends in the left-right direction below the first guide portion 81A after the first rack 81 has moved its leftmost position. The third portion 54A of the fourth rib 54 extends in the left-right direction above the second guide part 82A after the second lack 82 has moved to its rightmost position. Therefore, the second rib 52 and fourth rib 54 can prevent the first rack 81 and second rack 82 from rotating after they have most moved in the left-right direction. Further, the second rib 52 is inhibited from being an obstacle to the second rack 82 moving leftward, and the fourth rib 54 is inhibited from being an obstacle to the first rack 81 moving rightward.

<Modification>

This disclosure is not limited to the embodiment described above, and can be modified in various ways. For example, the first gap L1 and the second gap L2 are not limited to the values specified above. The first gap L1 may be larger than the second gap L2. Alternatively, the first gap L1 and the second gap L2 may be substantially equal.

As described above, the second rib 52 has a first portion 52A extending in the left-right direction, and second portions 52B and 52C extending downward from the left and right ends of the first portion 52A. The fourth rib 54 has a third portion 54A extending in the left-right direction, and fourth portions 54B and 54C extending upward from the left and right ends of the third portion 54A. Instead, the second rib 52 may have a first portion 52A and a second part extending downward from the middle part of the first portion 52A, or may have a first portion 52A only. Similarly, the fourth rib 54 may have a third portion 54A and a fourth part extending upward from the middle part of the third portion 54A. Alternatively, the fourth rib 54 may have a third portion 54A only.

The second rib 52 may be provided below the entire first engagement groove 91. Similarly, the fourth rib 54 may be provided above the entire second engagement groove 92.

The first rib 51 may be provided above the left half of the first region S1. In this case, the first rib 51 need not be provided above the right half of the first region S1. Similarly, the third rib 53 may be provided below the right half of the second region S2. In this case, the third rib 53 need not be provided below the left half of the second region S2. At least one another rib extending upward may be connected to the first rib 51. At least another rib extending downward may be connected to the third rib 53.

<Other Features>

In the present disclosure, the left-right direction is an example of "axial direction," the left side is an example of "first side in the axial direction," the right side is an example of "second side in the axial direction," and the up-down direction is an example of "perpendicular direction." The lower side is an example of "one side in the perpendicular direction," and the upper side is an example of "another side in the perpendicular direction."

While the description has been made in detail with reference to specific embodiment(s) thereof, it would be apparent to those skilled in the art that various changes and modifications may be made therein without departing from the spirit and scope of the above described embodiment(s).

What is claimed is:

1. A printing apparatus comprising:

a first supporting portion configured to support a roll having a printing medium wound around an axis extending from a first side toward a second side in an axial direction, the first supporting portion supporting the roll from the first side;

a second supporting portion configured to support the roll from the second side, the second supporting portion and the first supporting portion having an adjustable gap therebetween; and an adjusting mechanism configured to adjust the adjustable gap, the adjusting mechanism comprising:

a first rack including a first guide portion having a first engaging part and connected to the first supporting portion, and a first rack gear portion extending from the first guide portion toward the second side in the axial direction, the first rack gear portion having a first gear, the first rack being movable in a first area in the axial direction between a first position and a second position which is closer to the second side in the axial direction than the first position is to the second side;

a second rack including a second guide portion having a second engaging part and connected to the second supporting portion, and a second rack gear portion extending from the second guide portion toward the first side in the axial direction, the second rack gear portion configured to face the first rack gear portion in a perpendicular direction perpendicular to the axial direction and having a second gear configured to face the first gear in the perpendicular direction, the second rack being movable in a second area in the axial direction between a third position and a fourth position which is closer to the first side in the axial direction than the third position is to the first side, the first area and the second area defining one end and another end in the perpendicular direction, the one end being closer to the second gear than the another end is to the second gear in the perpendicular direction;

a pinion gear engaging with the first gear and the second gear; and a third supporting portion configured to rotatably support the pinion gear and configured to movably support the first rack and the second rack, the third supporting portion comprising:

a first engaging groove extending in the axial direction, and configured to engage with the first engaging part to movably support the first guide portion in the axial direction;

a second engaging groove extending in the axial direction and configured to engage with the second engaging part to movably support the second guide portion in the axial direction;

a first rib positioned closer to the another end than to the one end of the first area in the perpendicular direction, the first rib and the first area providing therebetween a first gap in the perpendicular direction;

a second rib positioned closer to the one end than to the another end of the first area in the perpendicular direction, the second rib and the first area providing therebetween a second gap in the perpendicular direction, the second rib and the first rack confronting each other in the perpendicular direction to provide therebetween the second gap when the first rack is positioned at the first position, the second rib and the first rack not confronting each other in the perpendicular direction when the first rack is positioned at the second position;

a third rib positioned closer to the one end than to the another end of the second area in the perpendicular direction, the third rib and the second area providing therebetween the first gap in the perpendicular direction; and a fourth rib positioned closer to the another end than to the one end of the second area in the perpendicular direction, the fourth rib and the second area providing therebetween the second gap in the perpendicular direction, the fourth rib and the second rack confronting each other in the perpendicular direction to provide therebetween the second gap when the second rack is positioned at the third position, the fourth rib and the second rack not confronting each other in the perpendicular direction when the second rack is positioned at the fourth position.

2. The printing apparatus according to claim 1, wherein the second gap is greater than the first gap.

3. The printing apparatus according to claim 1, wherein the second rib has a first portion extending along the one end of the first area in the axial direction, and has a second portion extending from the first portion opposite to the first area in the perpendicular direction; and wherein the fourth rib has a third portion extending along the another end of the second area in the axial direction, and has a fourth portion extending from the third portion opposite to the second area in the perpendicular direction.

4. The printing apparatus according to claim 3, wherein the first portion has first end portions in the axial direction, the second portion extending from each of the first end portions; and wherein the third portion has second end portions in the axial direction, the fourth portion extending from each of the second end portions.

5. The printing apparatus according to claim 1, wherein the another end of the first area has a first entire length and the one end of the second area has a second entire length;

wherein the first rib extends along the first entire length; and wherein the third rib extends along the second entire length.

6. The printing apparatus according to claim 1, wherein the second rib is positioned at the first side in the axial direction with respect to the first area; and wherein the fourth rib is positioned at the second side in the axial direction with respect to the second area.

7. A printing apparatus comprising:

a first supporting portion configured to support a roll having a printing medium wound around an axis extending from a first side toward a second side in an axial direction, the first supporting portion supporting the roll from the first side;

a second supporting portion configured to support the roll from the second side, the second supporting portion and the first supporting portion having an adjustable gap therebetween; and an adjusting mechanism configured to adjust the adjustable gap, the adjusting mechanism comprising:

a first rack including a first guide portion having a first engaging part and connected to the first supporting portion, and a first rack gear portion extending from the first guide portion toward the second side in the axial direction, the first rack gear portion having a first gear, the first rack being movable in a first area in the axial direction;

a second rack including a second guide portion having a second engaging part and connected to the second supporting portion, and a second rack gear portion extending from the second guide portion toward the first side in the axial direction, the second rack gear portion configured to face the first rack gear portion in a perpendicular direction perpendicular to the axial direction and having a second gear configured to face the first gear in the perpendicular direction, the second rack being movable in a second area in the axial direction, the first area and the second area defining one end and another end in the perpendicular direction, the one end being closer to the second gear than the another end is to the second gear in the perpendicular direction;

a pinion gear engaging with the first gear and the second gear; and a third supporting portion configured to rotatably support the pinion gear and configured to movably support the first rack and the second rack, the third supporting portion comprising:

a first engaging groove extending in the axial direction, and configured to engage with the first engaging part to movably support the first guide portion in the axial direction;

a second engaging groove extending in the axial direction and configured to engage with the second engaging part to movably support the second guide portion in the axial direction;

a first rib positioned closer to the another end than to the one end of the first area in the perpendicular direction, the first rib and the first area providing therebetween a first gap in the perpendicular direction;

a second rib positioned closer to the one end than to the another end of the first area in the perpendicular direction, the second rib and the first area providing therebetween a second gap in the perpendicular direction, the second rib having a first portion extending along the one end of the first area in the axial direction, and a second portion extending from the first portion opposite to the first area in the perpendicular direction;

a third rib positioned closer to the one end than to the another end of the second area in the perpendicular direction, the third rib and the second area providing therebetween the first gap in the perpendicular direction; and a fourth rib positioned closer to the another end than to the one end of the second area in the perpendicular direction, the fourth rib and the second area providing therebetween the second gap in the perpendicular direction, the fourth rib having a third portion extending along the another end of the second area in the axial direction, and a fourth portion extending from the third portion opposite to the second area in the perpendicular direction.

8. The printing apparatus according to claim 7, wherein the first portion has first end portions in the axial direction, the second portion extending from each of the first end portions; and wherein the third portion has second end portions in the axial direction, the fourth portion extending from each of the second end portions.

* * * * *